United States Patent [19]

Blumle

[11] Patent Number: 4,542,895

[45] Date of Patent: Sep. 24, 1985

[54] SEPARATOR PLATES FOR ROTATING FEED SEGMENTS OF A SHEET FEEDER

[75] Inventor: Martin Blumle, Gullesheim, Fed. Rep. of Germany

[73] Assignee: Winkler & Dunnebier Maschinenfabrik und Eisengiesserei GmbH & Co. KG, Neuwied, Fed. Rep. of Germany

[21] Appl. No.: 565,461

[22] Filed: Dec. 27, 1983

[30] Foreign Application Priority Data

Jan. 7, 1983 [DE] Fed. Rep. of Germany ..... 3300295

[51] Int. Cl.[4] ..... B65H 3/08

[52] U.S. Cl. ..... 271/101; 271/106

[58] Field of Search ..... 271/11, 94, 100, 101, 271/106

[56] References Cited

U.S. PATENT DOCUMENTS

| | | | |
|---|---|---|---|
| 3,380,353 | 4/1968 | Mittermayer | 271/100 X |
| 3,586,316 | 6/1971 | Elscheid | 271/101 X |
| 3,768,804 | 10/1973 | Swanson | 271/101 |

FOREIGN PATENT DOCUMENTS

| | | | |
|---|---|---|---|
| 533856 | 9/1931 | Fed. Rep. of Germany | 271/101 |

*Primary Examiner*—Richard A. Schacher

*Attorney, Agent, or Firm*—Collard, Roe & Galgano

[57] ABSTRACT

According to the invention, separator plates bevelled at the front edges are provided on the rotating feed segments of a sheet feeder, more particularly for envelope machines, which finally separate from the pile of blanks a blank for feeding, the front edge of the bottom flap of the blank having been separated from the pile by means of a tongue and vacuum device. The separator plates align the blank in the direction of conveyance, smooth it out, and then feed it to the extractor roller and engagement edge of the rotating feed segments.

2 Claims, 4 Drawing Figures

SEPARATOR PLATES FOR ROTATING FEED SEGMENTS OF A SHEET FEEDER

The present invention relates to separator plates for use with the rotating feed segments of a sheet feeder, particularly such as is used in envelope machines. Such separator plates finally separate from a pile of blanks the blank for feeding, the front edge of the bottom flap of which has been separated from the pile by means of a tongue and pivoting vacuum device. The separator plates align the blank in the direction of conveyance and feed the same to the extractor roller and the engagement edge of the feed segments.

The fully automatic filling or stuffing of envelopes on filling machines is increasing. Suitable envelopes for such machines are those having a wide opening, and particularly wide-opening envelopes in which the bottom flap is cut out in the form of a V. Consequently, wide-opening envelopes with a V-shaped cut-out bottom flap are increasingly required in the envelope market. The blanks for such wide-opening formats were heretofore extremely difficult to isolate from the pile of blanks on sheet feeders. For processing, the envelope blanks must be fed to the processing machine with the bottom flap situated in front so that the isolating and separating operation must be carried out on the blank bottom flap, the V-shaped cut-out of which being unfavorable for the sheet feeder.

When blanks of this kind are separated on a sheet feeder, the blanks separated from the pile by means of the tongue and pivoting vacuum device must be reliably separated from the pile by means of the separator plates and fed to the processing machine by the feed segments in accurate register and without any malfunction.

It is known to separate difficult blanks of this type by means of two additional auxiliary vacuum devices, each disposed adjacent to the middle main vacuum device and having a separately controlled vacuum applied thereto, and to bend the blanks into the periphery of the separator plates disposed on the rotating feed segments. Separation from the pile is carried out by means of separator plates whose front edges are disposed parallel to the axis of the rotating feed segments. Apparatus of this kind is described in U.S. Pat. No. 3,586,316, to Ehlscheid et al., granted June 22, 1971. Operation with such apparatus is to some extent satisfactory at low speeds, but at higher speeds difficulties recur in connection with separation by the sheet feeder, e.g. several blanks being fed simultaneously, the outer corners of the bottom flap being bent over and causing subsequent undesirable creasing. With feeders of this kind there are also considerable problems if the pile of blanks does not lie with the underside of the bottom flaps parallel to the pile plate, e.g. if one corner of the front edge of the bottom flap hangs down or dips and the other stands up. In such a case the bottom blank is engaged by the lateral auxiliary vacuum devices only at the hanging down or dipping corner of the bottom flap and is unilaterally bent. As a result, the blank is correctly engaged only on one side and by one separator plate, while the other separator plate moves past the raised corner of the bottom flap. The blank engaged in this way is threaded between the two rotating feed segments and is torn during further conveyance. This disturbance immediately results in stoppage of the machine.

Another disadvantage in operating with the two auxiliary vacuum devices lies in the geometric shape of the V cut-out bottom flap. The auxiliary devices engage the two far apart outer corners of the bottom flap while the main vacuum device engages the re-entrant central indentation. Since all the vacuum devices pivot about the same pivot, their suction points describe different paths. The bottom flap is therefore caused to bulge as it is bent into the periphery of the rotating separator plates. At high speeds this results in inaccurate register or even in the sheet slipping away from the vacuum devices and being lost.

A further disadvantage is that the two auxiliary vacuum devices and the separate vacuum control required therefor considerably increase the initial and maintenance costs of the sheet feeder.

The object of this invention is to modify the standard sheet feeder with rotating feed segments at favorable cost so that it can reliably and without malfunction feed even at high speeds the difficult blanks of the wide-opening formats having bottom flaps cut out in the form of a V.

This object, as well as others which will hereinafter become apparent is accomplished according to the present invention by providing the front edges of the separator plates with an outward bevel in the outer zone wherein the bevel angle $\alpha$ is larger than the angle $\alpha'$ of the front edge of the bottom flap of the blank being fed. The separator plates may be changed according to the angle $\alpha'$ of the sheets being fed.

The particular advantages of the invention are that the interchangeable modified separator plates reliably feed in accurate register and without malfunctioning even at high speeds the wide-opening envelopes in which the bottom flap is cut out in the form of a V. Also, the entire sheet feeder becomes simpler and easier to operate, and this in turn results in much lower initial, operating and maintenance costs.

The present invention will be described and understood more readily when considered with the embodiment of the invention illustrated in the accompanying drawings, in which.

Figure 1:
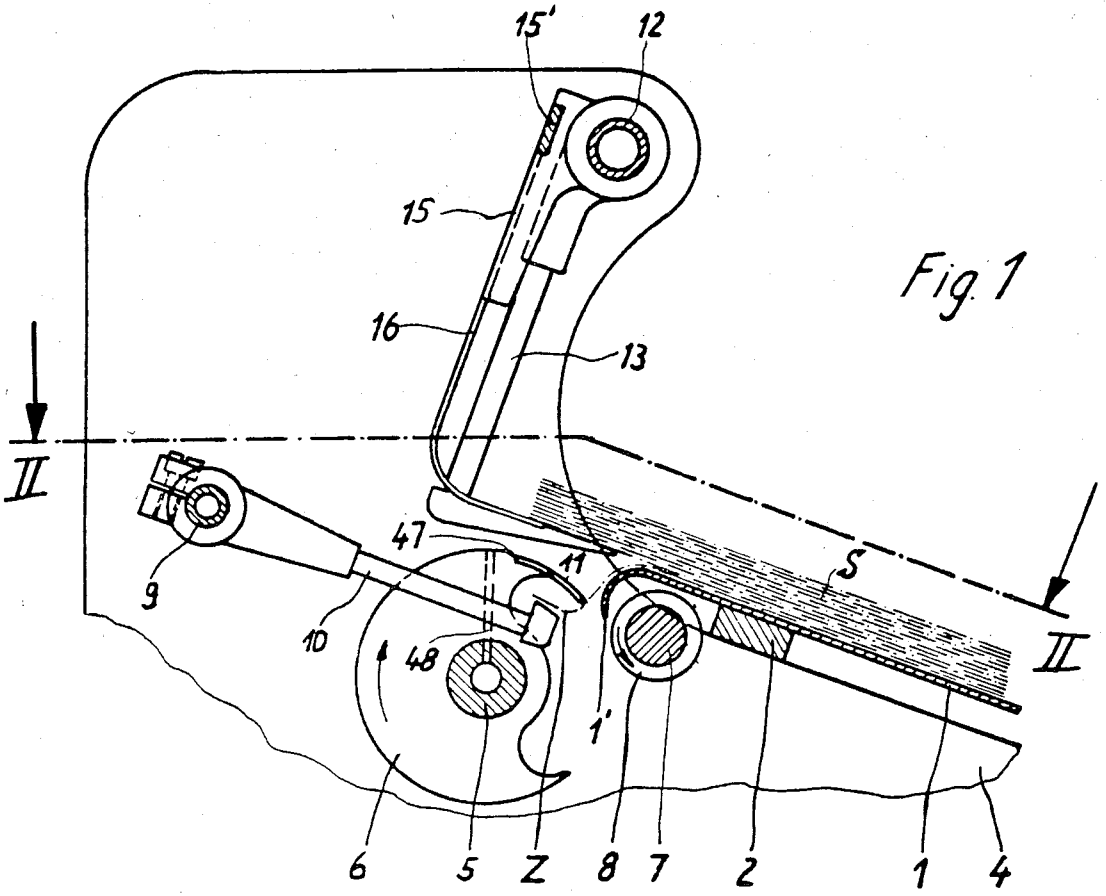
FIG. 1 is a cross-sectional view of a sheet feeder modified with the separator plates of the present invention taken along the line I—I of FIG. 2.
Figure 2:
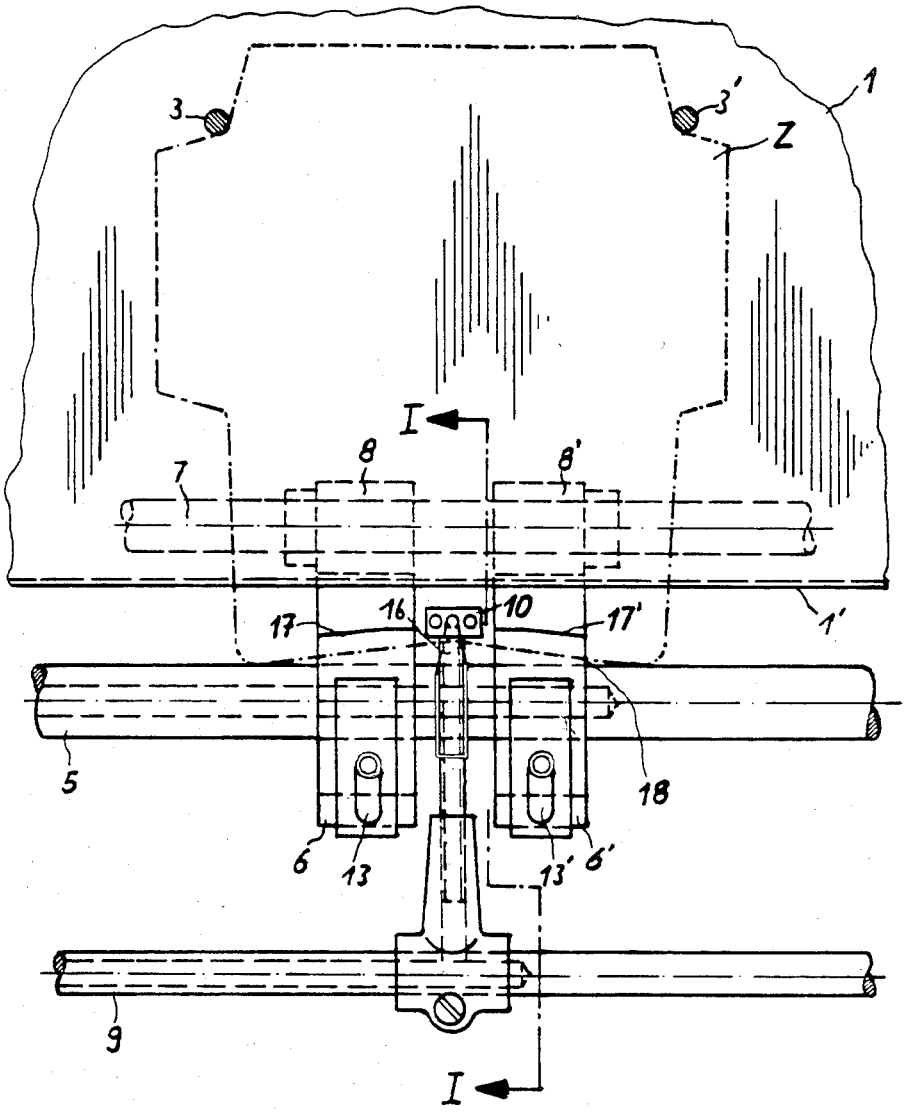
FIG. 2 is a cross-sectional view of the modified sheet feeder of FIG. 1 taken along the line II—II of FIG. 1.

Referring now to the drawings, there is shown in FIGS. 1 and 2, a plate 1 bearing the pile of blanks S having its front edge 1' bent downwardly. The pile of blanks S projects beyond the front edge 1' of plate 1 and is held in the correct position by means of stops 3 and 3'. Plate 1 is fixed to the side walls 4 of the sheet feeder by means of fixed cross-members 2 secured thereon.

A shaft, designated 5, with feed segments 6 and 6' fixed thereon is mounted rotatably in the side walls 4 of the sheet feeder. Shaft 5 performs one revolution per working cycle during which a blank Z is fed. The separator plates, designated 11 and 11', are shaped according to the invention and are interchangeably or removably secured to the segments 6 and 6' and are provided with an outward bevel in the outer zones thereof. The rubber rollers 8 and 8' which co-operate with feed segments 6 and 6' are secured on the extractor shaft 7.

A hollow shaft, designated 9, on which a vacuum device 10 is secured in the center, and a hollow shaft, designated 12, on which two pile supports 13 and 13' are secured, are mounted rotatably in the side walls 4 of the sheet feeder. A holder, designated 15, for a tongue 16 is mounted on shaft 12 so as to be rotatable relative thereto and is controlled via a link 15' independently of the angle of rotation of shaft 12. Shafts 9 and 12, together with the tongue 16, are caused to swing with stationary intervals therebetween in a known manner by means of control cams (not shown) or the like rotating in time with the feed operation.

Figure 3:
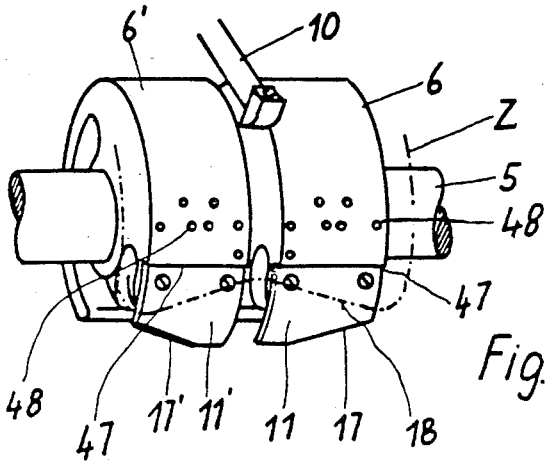
FIG. 3 is a perspective view of the two feed segments with the separator plates according to the present invention.
Figure 4:
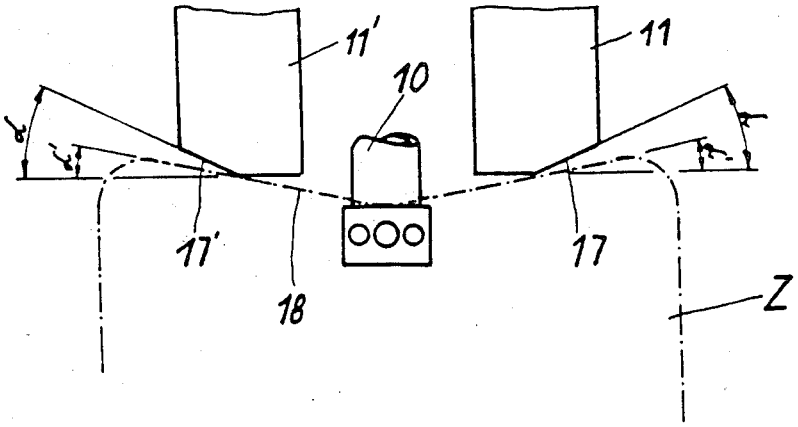
FIG. 4 diagrammatically shows the separator plates of the present invention and a wide-opening envelope blank with the bottom flap cut out in the form of a V engaged by the vacuum device.

FIG. 3 clearly shows the separator plates 11 and 11' according to the invention, which are interchangeable with other separator plates according to the shape of the blanks. These separator plates are secured in the form of segmental members on the feed segments 6 and 6'. FIG. 4 shows the relationship between the bevelling of the separator plates' front edges 17 and 17' and the shape of the blank for feeding. The bevel angle $\alpha$ is slightly larger than the angle $\alpha'$of the bottom flap front edge 18 of blank z.

In the operation of a working cycle of a modified sheet feeder incorporating the separator plates of the present invention, the tongue 16 is initially in the front position at rest at the pile of blanks S. Vacuum device 10 is then moved up against the pile S and remains in that position. Tongue 16 recedes and releases the bottom blank Z from the pile S so that it can be gripped by vacuum device 10. Tongue 16 then returns beneath the pile S. Pile supports 13 and 13' swing back and release the pile S and the bottom separated blank Z. Vacuum device 10 then starts its downward movement and swings as far as the bottom reversal point. Vacuum device 10 releases the blank Z once the separator plates 11 and 11' are situated sufficiently reliably above the front edge 18 of the bottom flap of the blank Z (see FIG. 1). Separator plates 11 and 11' now finally separate from the pile the blank Z which is being fed and which has been bent down over the front edge 1' of the pile plate, and the bevelled portions of the separators smooth the blank out. The pile supports 13 and 13' by now have resumed their front position of rest just before the engagement edge 47 of the feed segments together with the shaft 7 finally extracts the blank Z. As soon as the engagement edge 47 comes into contact with blank Z, vacuum builds up in the vacuum ports 48 of shaft 5 for further conveyance.

It is understood that the foregoing general and detailed descriptions are explanatory of the present invention and are not to be interpreted as restrictive of the scope of the following claims.

What is claimed is:

1. In an apparatus for feeding blanks from beneath a pile of blanks, each blank having a front edge with an angled cut-out, said apparatus including a tongue and pivoting vacuum device which separates the front edge of the bottom blank from the pile, an extractor roller, and rotating feed segments the engagement edge of which cooperate with the extractor roller to receive the fed blanks, the improvement comprising separator plates mounted on the rotating feed segments which align the blank in the direction of conveyance and feed the same to the extractor roller and the engagement edge of the feed segments, the front edges of the separator plates each having an outward bevel in the outer zone, said bevel having a bevel angle greater than the angle of the angled cut-out of the front edge of the blank being fed.

2. The apparatus according to claim 1, wherein the separator plates are releasably mounted on the feed segments so that they may be changed with other separator plates having different bevel angles as required by the angles of the angled cut-outs of the front edges of the blanks being fed.

* * * * *